US006408442B1

(12) United States Patent
Kang

(10) Patent No.: US 6,408,442 B1
(45) **Date of Patent: *Jun. 25, 2002**

(54) ATHLETIC GLOVE HAVING SILICONE-PRINTED SURFACE FOR CONSISTENT GRIPPING ABILITY IN VARIOUS MOISTURE CONDITIONS

(76) Inventor: Hye Sook Kang, c/o Hanyoung Kangaroo Co., Ltd, 610-11, Jung Kook-Dong, Kwang Jin-Gu, Seoul, 143-220 (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/459,610

(22) Filed: Dec. 13, 1999

Related U.S. Application Data

(63) Continuation of application No. 08/991,487, filed on Dec. 16, 1997, now Pat. No. 6,044,494, which is a continuation-in-part of application No. 08/780,068, filed on Dec. 23, 1996, now abandoned.

(30) Foreign Application Priority Data

Jul. 14, 1997 (KR) ..... 97-32642
Jul. 25, 1997 (KR) ..... 97-34964

(51) Int. Cl.[7] ..... A41D 19/00
(52) U.S. Cl. ..... 2/167; 2/161.1; 2/161.2
(58) Field of Search ..... 2/167, 161.2, 161.3, 2/161.1, 161.8, 159, 166, 169

(56) References Cited

U.S. PATENT DOCUMENTS 4,689,832 A * 9/1987 Mulvaney ..... 2/161.1
5,117,509 A * 6/1992 Bowers ..... 2/161.1
5,620,773 A * 4/1997 Nash ..... 2/161.7 X
5,625,900 A * 5/1997 Hayes ..... 2/161.1
6,044,494 A * 4/2000 Kang ..... 2/167

* cited by examiner

*Primary Examiner*—Gloria M. Hale
(74) *Attorney, Agent, or Firm*—Nath & Associates PLLC; Harold L. Novick

(57) ABSTRACT

An athletic glove having consistent gripping ability in various moisture conditions includes front and back joined together to fit the human hand. The front part is made of a thin, soft and supple fabric such as polyurethane-impregnated artificial leather or synthetic fabric. The front is printed with a pattern of silicone sealant. The pattern is preferably achieved by silk printing on contact areas in the front with a two-part silicone sealant in repeated patterns of fine lines of a narrow width. The printing is done such that the sealant penetrates into and bonds firmly with the fiber thereof when cured. A majority of the front surface is made of the fabric and does not bear the silicone. This allows the fabric to absorb and remove the moisture on the silicone surface by capillary action. The removal of the water from the silicone surface eliminates the effect of the thin film of water, which causes loss of grip. The fabric printed with silicone sealant imparts consistent gripping ability in various moisture conditions without losing the original good, soft and supple and tactile response of the fabric.

20 Claims, 3 Drawing Sheets

ATHLETIC GLOVE HAVING SILICONE-PRINTED SURFACE FOR CONSISTENT GRIPPING ABILITY IN VARIOUS MOISTURE CONDITIONS

CROSS REFERENCE TO RELATED APPLICATIONS

This is a continuation application of U.S. patent application of U.S. patent application Ser. No. 08/991,487 filed Dec. 16, 1997, U.S. Pat. No. 6,044,494, which is a continuation-in-part application of U.S. patent application Ser. No. 08/780,068 filed Dec. 23, 1996 and now abandoned.

BACKGROUND OF THE INVENTION

1. Field of the Invention

The present invention relates to an athletic glove and, more particularly, to an improved anti-slip glove, especially for use in conjunction with various athletic activities, having a palm surface printed with a pattern of silicone sealant and exhibiting a durable and consistent gripping ability over a variety of moisture conditions.

2. Description of Related Art

Athletic gloves are widely used for various kinds of sports, including golf, baseball (batting American football, tennis and racquetball, to cover and thereby protect the human hand from injury, cold weather, etc. Athletic gloves used in these various sports are typically made of a very thin, supple material, such as natural leather or polyurethane artificial leather, generally having a thickness of 0.4–0.8 mm. Though often worn for protection only, these gloves, if properly designed, are believed by many to be essential to enhance their athletic performance, with one of the most essential characteristics of an athletic glove being gripping ability. Though many existing leather gloves provide a very soft and supple feel, ample finger motion and a tactile response in addition to hand protection, the gripping ability of these gloves is generally considered inferior to that of the bare human hand.

"Tackified" leather gloves are significantly improved in terms of the enhancement of gripping ability by an impregnation of a conventional leather glove using a solution of a tackifying resin. However, the tackified material imparts a wet, oily, tacky feel, and the tacky residue is objectionable to the skin. To solve this problem, U.S. Pat. No. 4,689,832 issued to Mulvaney describes a glove whose inner surface is "de-tackified" with a solution containing nitrocellulose and silicone resins.

Another category of gloves are those having the palm piece and the back piece, or at least the palm piece, made out of polyurethane artificial leather, which generally provides the same good properties as does natural leather. Moreover, many woven and non-woven polyurethane artificial leathers are much more durable than natural (or tackified natural) leather, but have generally poorer gripping ability due to a lower friction force than the natural leather. To improve the gripping ability, U.S. Pat. No. 5,117,509 issued to Bowers describes a sport glove whose palm portion is made out of a sheet of leather material prepared by a chrome tanning process with a reduced oil content, wherein a uniformly thin layer of silicone sealant is bonded to the entire palm piece, so as to penetrate partially into the sheet of leather material and form a continuous coating throughout the palm piece. This continuous coating of silicone sealant, however, inhibits the desired properties of a soft and supple feel, ample finger motion, and tactile response, especially when used on thin leather of a thickness of 0.4–0.8 mm. This resulting degradation of the desired properties of an athletic glove occurs regardless of the degree of penetration, whether partial or thorough. In particular, due to the thin film effects of water, such a glove becomes very slippery when water or moisture of any kind (rain, perspiration, etc.) is present on the continuous silicone sealant coating, also regardless of the degree of penetration of the silicone sealant coating.

Silicone is used in the art of seamless gloves, such as surgical gloves manufactured as one integrally formed piece by dip-coating a solid hand-shaped mandrel to form a thin glove-like shell on the mandrel and removing the shell after curing. Such a glove, however, is so tight and its inner surface is so tacky that many problems arise; for example, removing the glove sometimes causes skin pain. U.S. Pat. No. 5,620,773 issued to Nash describes the dispersion of a one-part or two-part silicone with silica particles being embedded at the final dipping process, to form a glove having a textured inner surface having less friction and being easier to put on and to take off. Of course, the gripping ability of the glove's outer surface as required for an athletic glove is unaffected.

Another category of glove is the winter sporting glove, to the palm area of which a patch of synthetic leather is secured by sewing. As described in U.S. Pat. No. 5,625,900 issued to Hayes, a tacky layer of elastomeric polymer is applied to the patch as a continuously embossed pattern having a plurality of openings. Though this kind of glove greatly improves gripping ability, the desired soft and supple feel, ample finger motion, and tactile response is impossible to achieve with the addition of the patch plus tacky layer, so that these gloves are impractical for sports activities requiring high sensitivity, such as golfing or batting. That is, these kinds of gloves, being especially useful for skiing, snowmobiling and other cold-weather sports activities, are generally provided with a thicker lining insulation, padding and other bulky layers. Therefore, though the additional layers do not detract from the objective of improved gripping ability, the added thickness inherently inhibits or even destroys sensitivity. Moreover, when water or moisture of any kind is present on the surface of the elastomeric polymer, the glove becomes slippery due to the thin film effects of water. These undesirable properties, i.e., excessive slippage in moisture conditions and poor sensitivity, preclude using an athletic glove of this type for golfing or batting.

All other existing athletic gloves have extremely poor gripping ability when dampened or fully saturated with water or moisture of any kind. Furthermore, since gripping ability is inconsistent under varying moisture conditions, the glove wearer (athlete) may lose the grip of a golf club or baseball bat or, sensing the change in grip, may exert excessive gripping force and grip too tightly so as to make the whole body overly rigid and thereby spoil the athletic motion of hitting, swinging, etc. Accordingly, there is a substantial need for athletic gloves having improved gripping ability, which is consistent in various moisture conditions, without losing a good, soft and supple feel, finger motion, and tactile response.

SUMMARY OF THE INVENTION

Accordingly, in order to overcome the above drawbacks of conventional athletic gloves, it is the object of the present invention to provide an improved anti-slip glove. Such a glove is embodied by an athletic glove including a palm portion made of a thin polyurethane-impregnated artificial leather exhibiting improved gripping ability, which is consistent over various moisture conditions and maintains the original properties of the leather material, i.e., a good, soft and supple feel, ample finger motion and tactile response, to promote sensitivity.

Therefore, in accordance with a preferred embodiment of the present invention, there is provided an athletic glove largely comprising a palm portion and a back portion. The palm portion is made of artificial leather having a thickness of 0.4–0.8 mm on which a silicone sealant is printed, and properly penetrated to bond with the fibers of the artificial leather, in repeated patterns of fine lines, dots, geometric shapes, alphanumeric characters or a combination thereof, to provide improved gripping ability which is consistent over a variety of moisture conditions. The palm portion is preferably made of polyurethane-impregnated artificial leather, whether woven or non-woven, and is silk-printed, preferably with a two-part silicone sealant which requires more than one day to cure at room temperature but cures in approximately one or two minutes at 130–170° C. In the process of the present invention according to a preferred embodiment, the printed silicone sealant should be adequately penetrated and properly bonded with the fiber of the polyurethane-impregnated artificial leather, so as to cover a minority portion(20–40%) of a surface area of the palm portion and to have a substantially level surface after being heat cured.

The athletic gloves of the present invention are especially useful as golf gloves, batting gloves, etc., which require high sensitivity together with good gripping ability.

Though the elastomeric material of conventionial athletic gloves is soft and supple, it is much bulkier and stiffer than bare artificial leather when applied as an additional embossed layer or in a partially penetrated continuous manner and thereby inhibits good, soft and supple feel, finger motion, and tactile response, despite an improved gripping ability. Moreover, the gripping ability of an athletic glove adopting the principles of the conventional art falls off greatly when the glove becomes wet or saturated with moisture, due to the thin film effects of water. However, when silicone sealant is applied in repeated patterns such as fine lines, dots, geometric shapes, alphanumeric characters or a combination thereof, so as to cover a minority portion of the palm surface, and is properly penetrated into the fibers of the polyurethane-impregnated artificial leather before curing by heat treatment, the gripping ability is greatly improved over the bare artificial leather, without losing its original good, soft and supple feel, finger motion, and tactile response. Therefore, consistent gripping ability of the athletic glove of the present invention is maintained even in varying moisture conditions.

BRIEF DESCRIPTIONS OF THE DRAWINGS

The present invention will become more fully understood from the detailed description given hereinbelow and the accompanying drawings, which are given by way of illustration only snd thus are not limitative of the present invention, wherein.

Figure 5A:
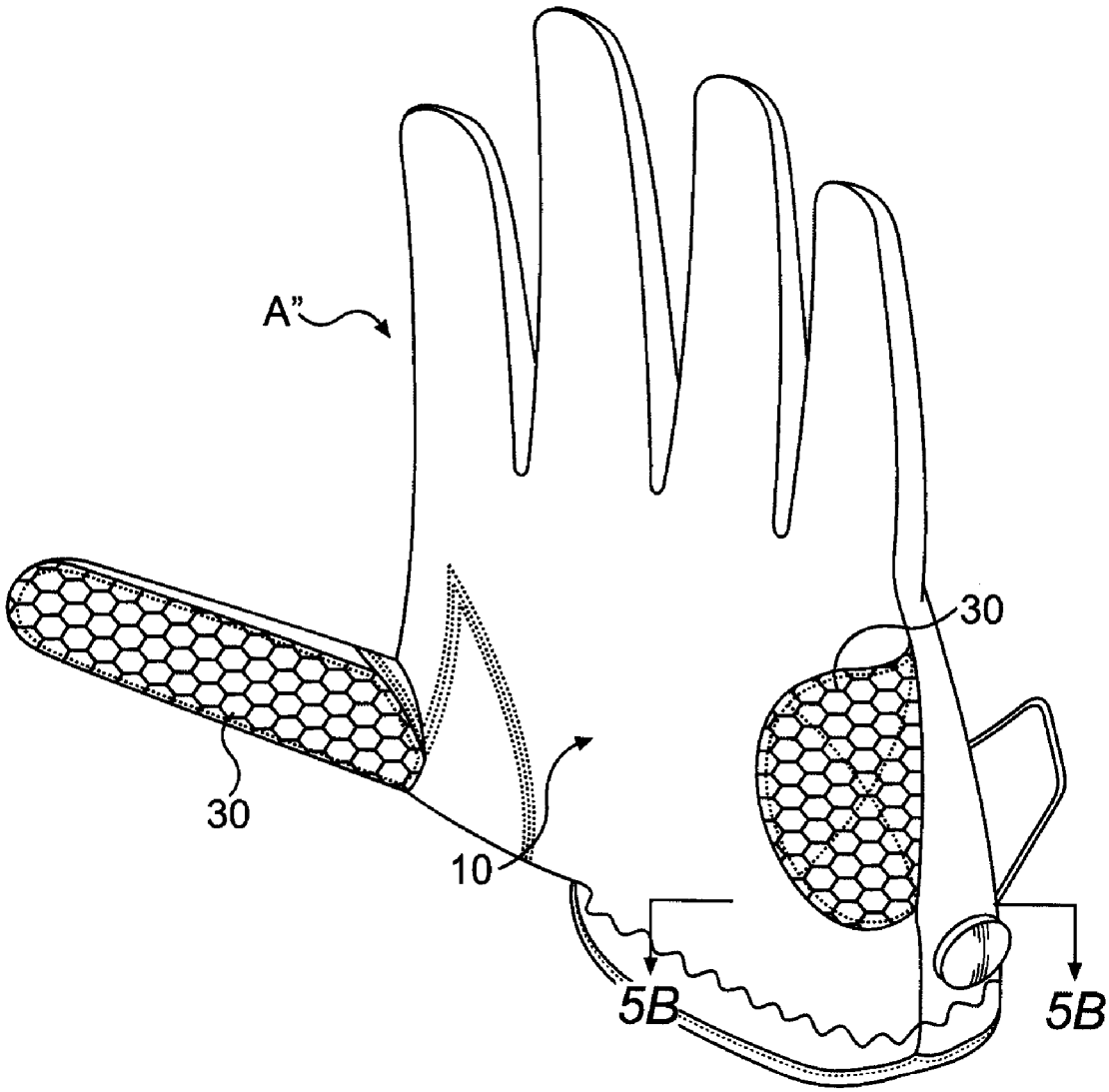
Figure 5B:
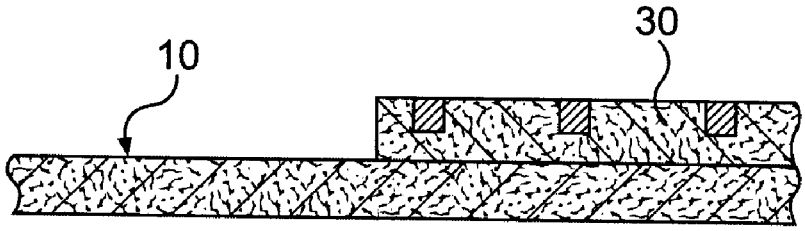

FIG. 5(A) is a perspective view of yet another embodiment of the present invention, showing the hexagon-patterned silicone sealant penetrated into polyurethane-impregnated artificial leather patches attached by sewing to contact areas of the palm portion of the athletic glove according to the present invention; and FIG. 5(B) is an enlarged sectional view of the contact areas shown in FIG. 5(A), taken along line 5(B)—5(B).

DETAILED DESCRIPTION OF THE PREFERRED EMBODIMENTS

Figure 1:
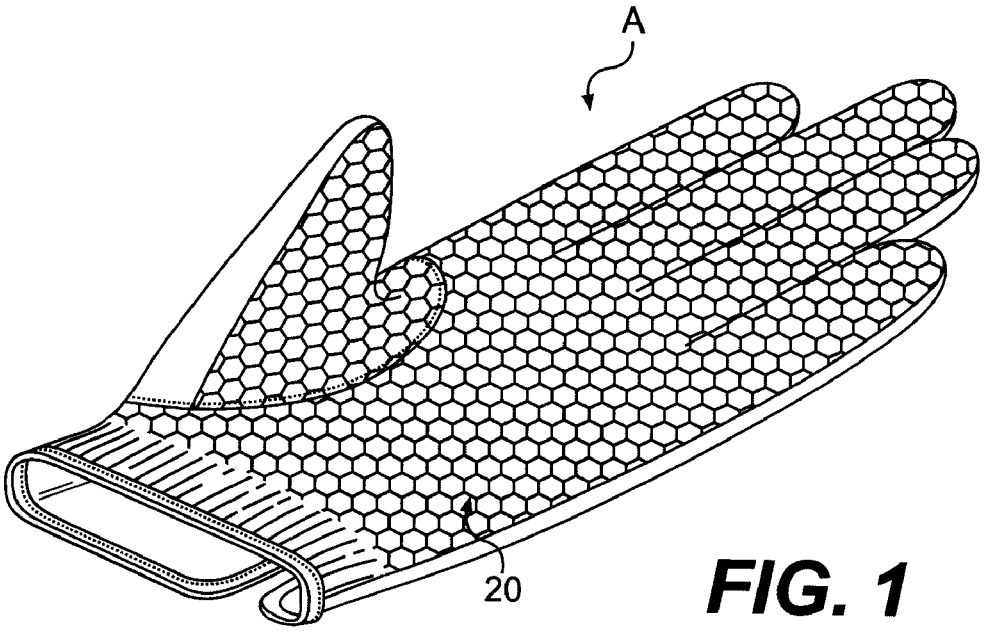
FIG. 1 is a perspective view of an athletic glove according to the present invention, particularly illustrating a palm portion thereof.

Referring now to the drawings wherein the depictions are for purposes of illustrating a preferred embodiment of the present invention only and not for the purpose of limiting the same, FIG. 1 illustrates an athletic glove according to a first embodiment of the present invention. The glove is largely comprised of a palm portion and a back portion which are preferably cut to fit the human hand snugly by being joined along the edges thereof in a conventional, substantially continuous manner, preferably by sewing. A particularly suitable material for the palm portion is a thin, soft and supple polyurethane-impregnated artificial leather, but other synthetic and made-made materials, including natural leathers, may be used to embody the present invention. The back portion may be of the same material or different materials, depending on user preference, the intended usage (e.g., sport) of the glove, and environmental conditions.

As shown in FIG. 1, the palm portion is comprised of a palm piece and a thumb piece, which include opposing contact areas of the glove (A) on which a pattern 20 of silicone sealant is printed by a silk-printing method using, preferably, a two-part silicone sealant. As the two-part silicone sealant of the present invention, KE-1300T silicone with CAT-1300 hardening agent (manufactured by Shin-Etsu Chemical of Japan) may be used, in which 10–30% by volume of the hardening agent is added to the silicone and thoroughly mixed before application. Due to the comparatively low flowing capacity of silicone sealant, a somewhat coarse silk-printing plate is utilized. Preferably, a minimal volume of the silicone sealant is applied to the polyurethane-impregnated artificial leather.

Figure 2:
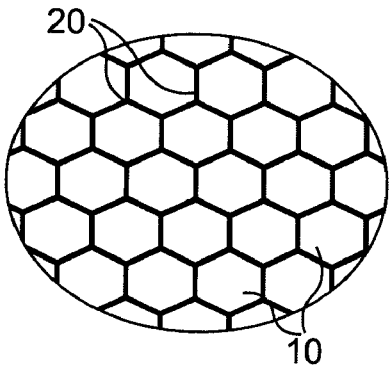
FIG. 2 is an enlarged plan view of a hexagon-patterned silicone sealant, which has penetrated into the fibers of the palm portion, according to the present invention.
Figure 3:
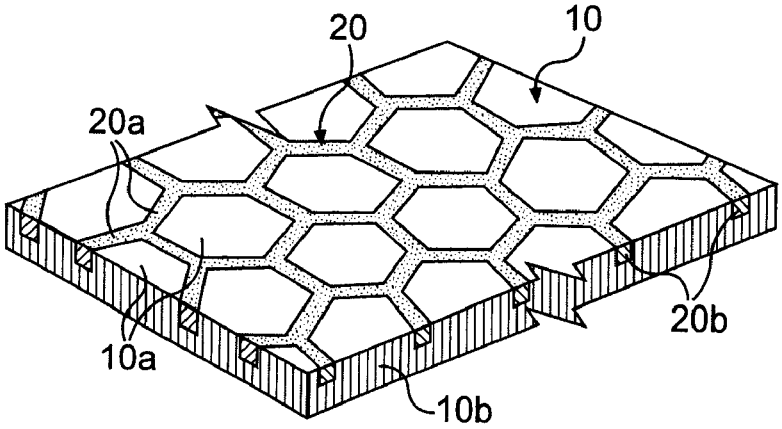
FIG. 3 is an enlarged perspective view of a section of the palm portion, according to the present invention.

As shown in FIGS. 2 and 3, the gripping ability of the glove (A) according to the present invention is derived partly from a contact surface 20*a* of the silicone sealant together with an anchored channel 20*b* thereof, which is penetrated into the polyurethane fiber 10*b* to a depth of approximately half its thickness, and partly from a bare surface area 10*a* of the polyurethane-impregnated artificial leather 10. These two surfaces, 10*a* and 20*a*, generally preserving the substantially level surface of the original polyurethane-impregnated artificial leather 10, are the characteristic elements of the present invention.

This substantially level, combinational surface formed by the contact surface 20*a* and the bare surface area 10*a* has better gripping ability than bare polyurethane-impregnated artificial leather, which is consistent over a variety of moisture conditions, thanks to the superior characteristics of the combinational surface. That is, the pattern 20 of silicone sealant, which covers a minority surface area portion of preferably 20–40% of an exterior contact area portion of the palm portion, with the silicone sealant being properly penetrated into and bonded with the polyurethane fiber 10*b* after printing, retains the same original characteristics of the polyurethane-impregnated artificial leather, i.e., good, soft and supple feel, ample finger motion, tactile response etc., but with improved gripping ability which is consistent over a variety of moisture conditions (rain, perspiration, etc.) and even when fully saturated with water.

Figure 4A:
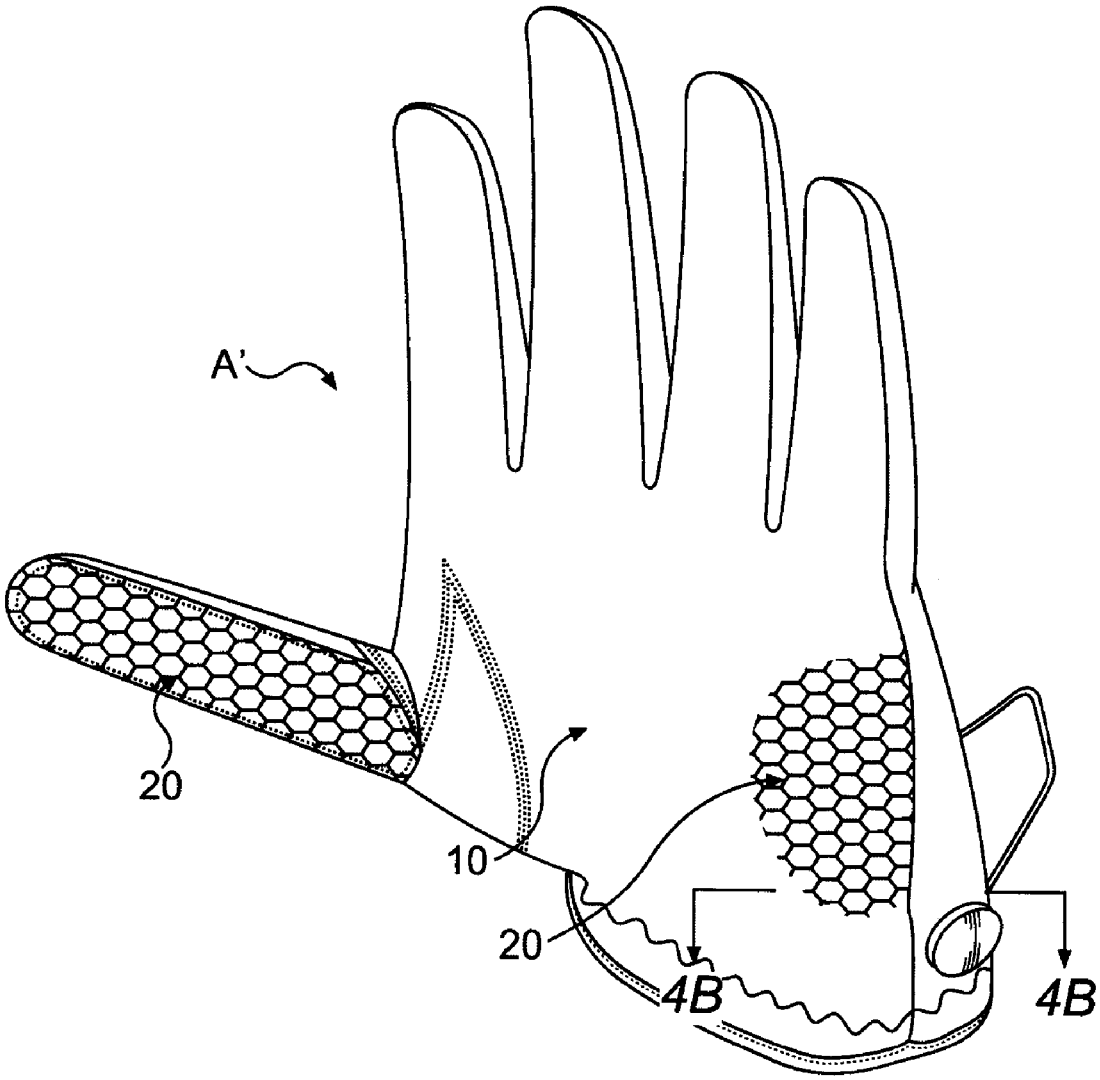
FIG. 4(A) is a perspective view of another embodiment of the present invention, showing hexagon-patterned silicone sealant penetrated into contact areas of the palm portion of the athlethic glove according to the present invention.
Figure 4B:
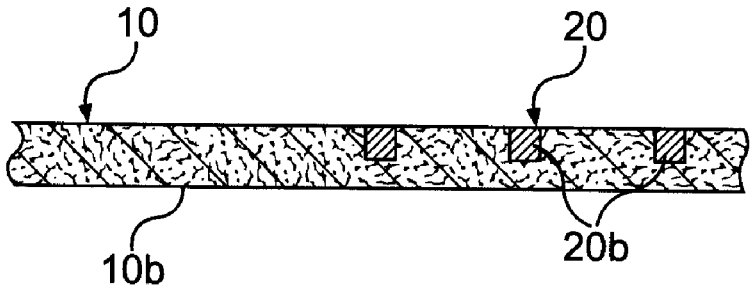
FIG. 4(B) is an enlarged sectional view of the contact areas shown in FIG. 4(A), taken along the line 4(B)—4(B)

FIGS. 4(A) and 4(B) show the second embodiment of the present invention. In this embodiment, the silicone sealant of the present invention is printed only on the contact areas of the palm portion of a glove (A').

FIGS. 5(A) and 5(B) show the third embodiment of the present invention, in which a glove (A") comprises a plurality of patch portions 30 made of polyurethane-impregnated artificial leather sewn conventionally onto the contact areas of the palm portion of the glove. In this embodiment, the silicone sealant of the present invention is printed only on the patch portions 30.

To embody the present invention, a silk print of the properly mixed two-part silicone sealant is made in repeated patterns of fine lines, dots, geometric shapes, alphanumeric characters or a combination thereof, on the surface of a thin piece of the polyurethane-impregnated artificial leather 10, comprising the palm portion, having a thickness of 0.4–0.8 mm. The thus-printed palm portion is left at room temperature, preferably at 10–30° C., until the silicone sealant is properly penetrated into the polyurethane fibers 10*b* and so that the contact surface 20*a* of the printed silicone substantially evens with the bare surface area 10*a*. The resultant is cured for approximately one or two minutes at 130–170° C.

It is quite important in the process of this invention that the printed silicone sealant is sufficiently penetrated into, and bonded with, the fibers of the polyurethane-impregnated artificial leather, so as not to be excessively embossed after heat-curing. That is, though not explicitly shown in the drawings, the contact surface 20*a* may actually be slightly raised with respect to the bare surface area 10*a*, to enhance the gripping ability accordingly, but not so much as to impede a natural capillary action of the polyurethane fibers 10*b* of the bare surface area adjacent to the pattern 20 of the printed silicone sealant, which draws any moisture which may be present on the contact surface into the polyurethane fibers. In fact, even if the fibers are fully saturated with water, the inherent squeezing action of the wearer's hand, which occurs intrinsically between the repeated patterns during gripping, will expel a sufficient quantity of moisture from the contact areas of the palm portion so that the capillary action will resume.

The gloves of the present invention are especially useful for golf gloves, batting gloves, racquetball gloves, etc., requiring an optimally soft and supple feel, ample finger motion, tactile response, and good gripping ability in various moisture conditions. When the silicone sealant is applied in the repeated patterns in such a manner as to cover a minority of the exterior contact area portion of the palm portion, and is properly penetrated into and bonded with the fibers of the polyurethane-impregnated artificial leather before heat curing to maintain a substantially level surface after curing, the gripping ability of the glove becomes improved over bare polyurethane-impregnated artificial leather, without losing its good, soft, and supple feel, finger motion and tactile response, and is consistent in a variety of moisture conditions. Water on the contact surface 20*a* of the printed silicone sealant is dispelled into the polyurethane fiber 10*b* of the bare surface area 10*a* of the artificial leather, adjacent to the contact surface which is at roughly the same level, by prompt capillary action when gripping a golf club, baseball bat etc., and prevents the thin film effects of water, to provide the same good gripping ability as that under normally dry conditions.

Additional modifications and improvements of the invention may also be apparent to those skilled in the art. Thus, the particular combination of parts described and illustrated herein is intended to represent only one embodiment of the invention, and is not intended to serve as limitations of alternative devices within the spirit and scope of the invention, in which a silicone-sealant-printed palm portion of an athletic glove is free from the thin film effects of water by a capillary action of a majority of the palm portion surface bearing no printing of silicone sealant, and the surface of the printed portion is sufficiently even with the level of the bare surface, without excessive embossing, to prevent a hindrance of the capillary action drawing off the moisture on the silicone-sealant-printed surface. Further, those skilled in the art will recognize that the sports glove defined and claimed herein is additionally applicable for other non-sports, special use endeavors requiring improved gripping ability such as aviation flight gloves and the like and, for the purposes of this application, the term "sports glove" shall be defined to encompass such broader meaning.

What is claimed is:

1. A glove comprising:

a back part and a front part combined with the back part, to fit a hand, said front part comprised of a thin, soft and supple base fabric having an exterior contact area for gripping; and a pattern comprised of a silicone sealant located on said base fabric to form a contact surface covering at least a portion of said exterior contact area for gripping, said silicone sealant penetrating into said base fabric to form a plurality of anchored channels.

2. The glove as claimed in claim 1, wherein said silicone is so patterned that the fabric portions not touched by the silicone pattern provide capillary action for absorbing moisture on the surface of the silicone sealant.

3. The glove as claimed in claim 2 wherein the silicone sealant is printed on and penetrates into said fabric and protrudes or is in the same plane as the exterior surface of the fabric.

4. The glove as claimed in claim 3, wherein said fabric is polyurethane-impregnated artificial leather.

5. The glove as claimed in claim 3, wherein said fabric is synthetic material.

6. The glove as claimed in claim 1, wherein the silicone sealant is a two-part silicone sealant.

7. The glove as claimed in claim 6, wherein the two-part silicone sealant is comprised of KE-1300T silicone with CAT-1300 hardening agent, in which 10–30% by volume of the hardening agent is added to the silicone and thoroughly mixed before application.

8. The glove as claimed in claim 1, wherein said contact surface covers 20–40% of the exterior contact area for gripping.

9. The glove as claimed in claim 1, wherein said pattern is made of at least one selected from the group consisting of fine lines, dots, geometric shapes and alphanumeric characters, to form a repeated pattern.

10. The glove as claimed in claim 1, said fabric has a thickness of 0.4–0.8 mm.

11. The glove as claimed in claim 3, wherein the anchored channels have a depth of penetration equal to half the thickness of said fabric.

12. The glove as claimed in claim 1, wherein said pattern extends throughout the palm and finger portions.

13. The glove as claimed in claim 1, wherein said pattern is a hexagon pattern.

14. The glove as claimed in claim 1, wherein said pattern of silicone is in a form of a plurality of patches printed and penetrated into selected portions of said exterior contact area for gripping.

15. The glove as claimed in claim 1, wherein said pattern of silicone is in a form of a plurality of patches are sewn into selected portions of said exterior contact area.

16. A glove comprising a back and a front part combined with the back part, to fit a hand snugly, the front part obtained by a process comprising the steps of:

printing a predetermined amount of a two-part silicone sealant in repeated patterns on at least a portion of an exterior surface of a polyurethane-impregnated artificial leather or synthetic fabric having a thickness of 0.4–0.8 mm;

holding the printed leather at a temperature of 10–30 degrees centigrade, to allow for a predetermined amount of penetration of the silicone sealant; and curing the silicone-sealant-penetrated leather or synthetic fabric for up to two minutes at a temperature of 130–170 degrees centigrade.

17. The glove as claimed in claim 16, wherein said printing step is performed by a silk-printing process.

18. The glove as claimed in claim 17, wherein the minority portion bearing the repeated patterns of two-part silicone sealant constitutes 20–40% of the exterior surface printed by said printing step.

19. The glove as claimed in claim 18, wherein the two part silicone sealant is comprised of KE-1300T silicone with CAT-1300 hardening agent, in which 10–30% by volume of the hardening agent is added to the silicone and is thoroughly mixed before being used in said printing step.

20. A glove comprising:

a back part and a front part connected to said back part so as to fit a hand, said front part comprised of a thin, soft and supple base fabric having a contact area with an exterior surface for gripping;

a plurality of channels located in said contact area and extending from said exterior surface of said contact area into said fabric, said channels forming a pattern in said contact area; and a silicone sealant filling said channels.

* * * * *